US011278822B2

(12) United States Patent
Stevkovski

(10) Patent No.: US 11,278,822 B2
(45) Date of Patent: Mar. 22, 2022

(54) TOY CONSTRUCTION BLOCK KIT

(71) Applicant: Huntar Company, Union City, CA (US)

(72) Inventor: Saso Stevkovski, Vienna (AT)

(73) Assignee: Huntar Company, Union City, CA (US)

( * ) Notice: Subject to any disclaimer, the term of this patent is extended or adjusted under 35 U.S.C. 154(b) by 233 days.

(21) Appl. No.: 16/602,195

(22) Filed: Aug. 28, 2019

(65) Prior Publication Data

US 2021/0060449 A1 Mar. 4, 2021

(51) Int. Cl.
*A63H 33/06* (2006.01)

(52) U.S. Cl.
CPC ..... *A63H 33/062* (2013.01)

(58) Field of Classification Search
CPC .... A63H 33/06; A63H 33/062; A63H 33/065; A63H 33/08; A63H 33/082; A63H 33/084; A63H 33/086
USPC ..... 446/124, 125, 126, 127, 128
See application file for complete search history.

(56) References Cited

U.S. PATENT DOCUMENTS 2,609,638 A * 9/1952 Lindenmeyer ..... A63H 33/107 446/126
3,144,881 A * 8/1964 Sproull ..... B03C 3/49 138/117
3,819,188 A * 6/1974 Freedman ..... A63F 9/12 273/160
4,159,592 A * 7/1979 Gabriel ..... A63H 33/101 24/287
4,381,619 A * 5/1983 Griffin ..... A63H 33/084 273/157 R
4,631,040 A * 12/1986 Shiraishi ..... A63H 17/002 446/124
4,643,427 A * 2/1987 Wozniak ..... A63F 9/1288 273/160
5,183,430 A * 2/1993 Swann ..... A63H 33/04 446/104
5,373,477 A * 12/1994 Sugibayashi ..... G11C 5/143 327/541
5,538,452 A * 7/1996 Kurani ..... A63F 9/088 446/102
5,704,186 A * 1/1998 Alcalay ..... A63H 33/062 52/848
5,823,531 A * 10/1998 Huber ..... A63H 33/08 273/156
6,592,421 B1 * 7/2003 Clever ..... A63H 33/082 446/108

(Continued)

*Primary Examiner* — Joseph B Baldori
(74) *Attorney, Agent, or Firm* — Jonathan Grant; Grant Patent Service

(57) ABSTRACT

A toy construction block kit is disclosed. The basic unit of the toy construction block unit has three basic sides, with two side walls and a connecting wall. Each of the two side walls have 'tongues" extending from their interior sides. The back connecting wall has means for reversibly capturing the tongues. The construction block units have two tongues that stick out from opposing walls, and a distal part which contains a double receiving clip. As each construction block unit has the two tongues and a double receiving clip, when two blocks are pushed together, they double lock. The construction block unit can be attached to one or more other construction block units, or could be attached to a blank cube.

20 Claims, 11 Drawing Sheets

(56) References Cited

U.S. PATENT DOCUMENTS

| | | | | |
|---|---|---|---|---|
| 7,007,436 | B1 * | 3/2006 | Kelley | E04B 2/16 52/309.7 |
| 8,007,338 | B2 * | 8/2011 | Stevkovski | A63H 33/062 446/101 |
| 8,402,710 | B2 * | 3/2013 | Cables | E04B 2/46 52/604 |
| 8,403,723 | B1 * | 3/2013 | Haner | A63H 33/08 446/120 |
| 8,495,850 | B1 * | 7/2013 | Lin | E04B 2/18 52/592.6 |
| 9,522,342 | B2 * | 12/2016 | Jazouli | A63H 33/086 |
| 10,857,476 | B2 * | 12/2020 | Wong | A63H 33/086 |
| 11,020,683 | B2 * | 6/2021 | Fang | A63H 33/062 |
| 2009/0191784 | A1 * | 7/2009 | Stevkovski | A63H 33/062 446/120 |
| 2010/0330867 | A1 * | 12/2010 | Fogel | A63H 33/062 446/124 |
| 2013/0000155 | A1 * | 1/2013 | Romer | A43B 3/0031 36/136 |
| 2018/0021689 | A1 * | 1/2018 | Cochella | A63H 33/101 446/124 |
| 2018/0326319 | A1 * | 11/2018 | Purwar | A63H 33/12 |
| 2019/0275441 | A1 * | 9/2019 | Beaulieu | A63H 33/108 |
| 2019/0321741 | A1 * | 10/2019 | Park | A63H 33/067 |
| 2021/0060449 | A1 * | 3/2021 | Stevkovski | A63H 33/065 |

* cited by examiner

TOY CONSTRUCTION BLOCK KIT

BRIEF DESCRIPTION OF THE FIGURE

The figures depict various embodiments of the described methods and system and are for purposes of illustration only. One skilled in the art will readily recognize from the following discussion that alternative embodiments of the methods and systems illustrated herein may be employed without departing from the principles of the methods and systems described herein.

DETAILED DESCRIPTION OF THE EMBODIMENT

Figure 1:
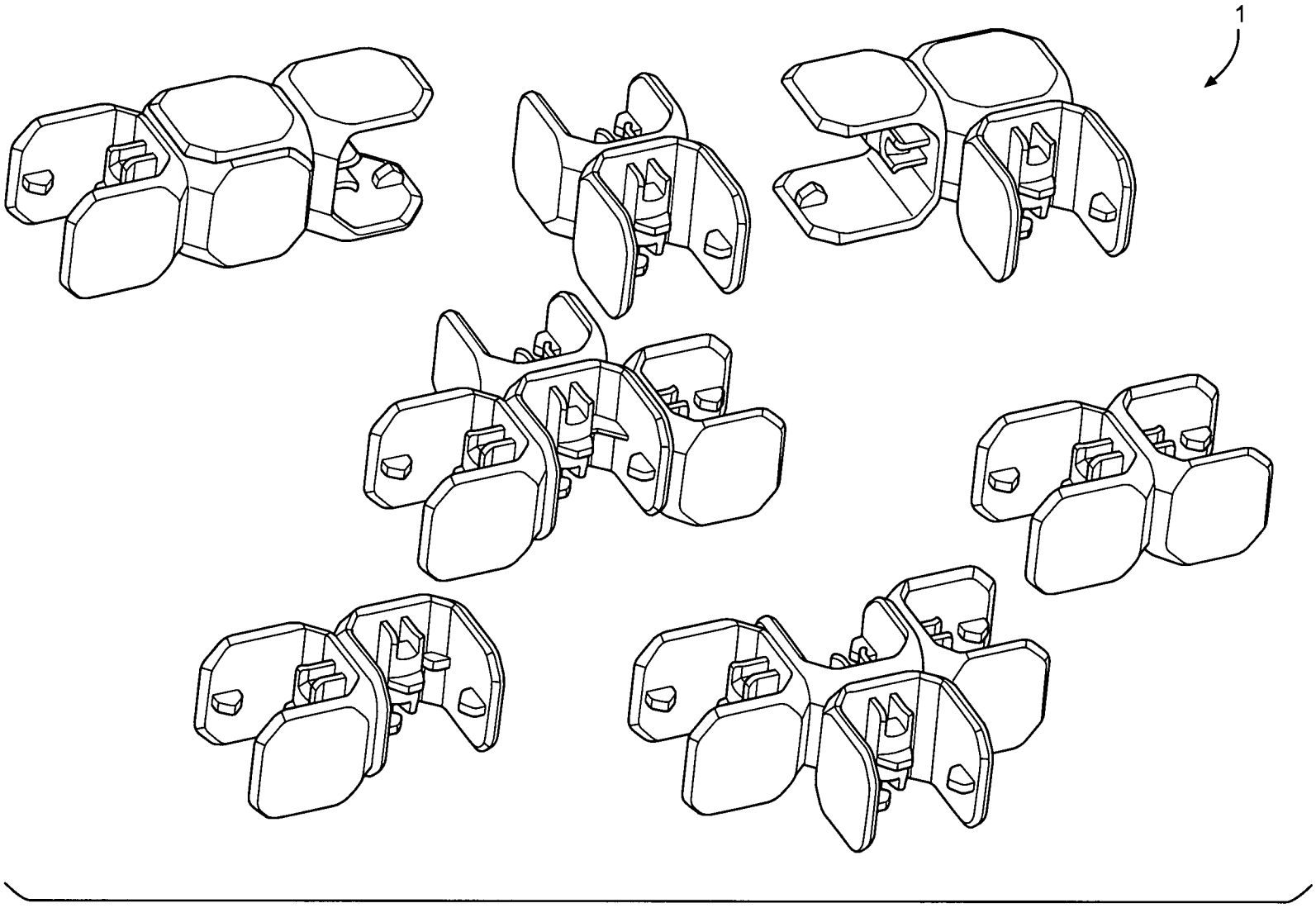
FIG. 1 is a perspective view of part of a construction block unit
Figure 4:
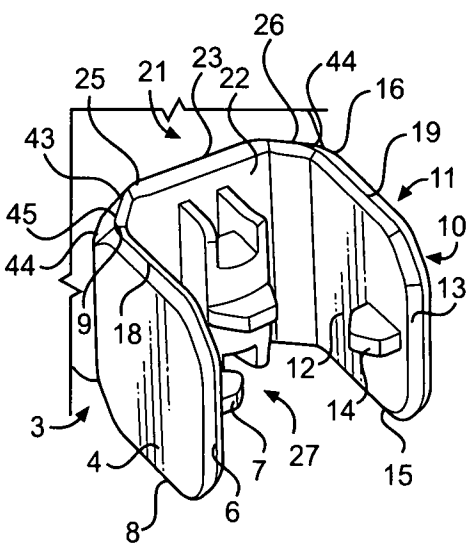
FIG. 4 is another perspective view of a construction block unit.
Figure 3:
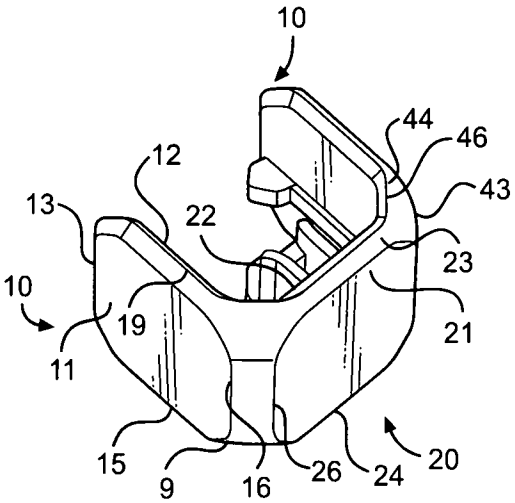
FIG. 3 is an underside perspective view of a construction block unit.
Figure 2:
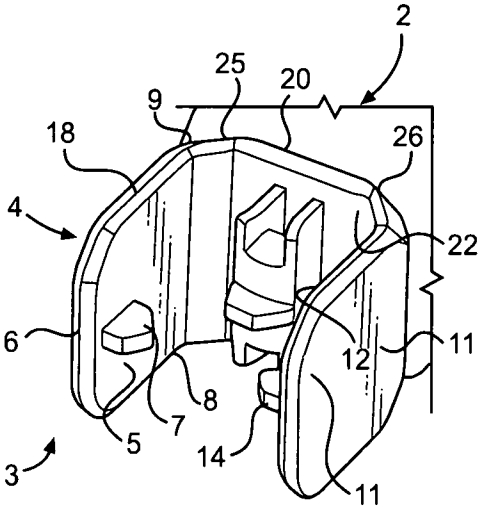
FIG. 2 is a perspective view of a construction block unit.
Figure 6:
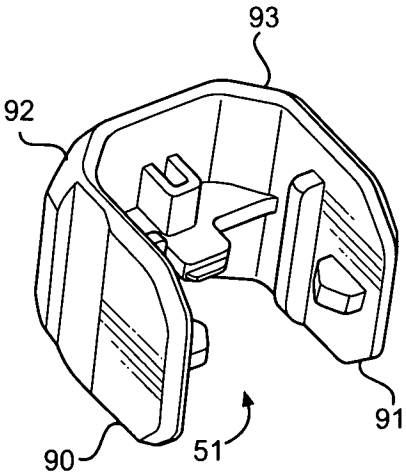
FIG. 6 is an alternative embodiment of the block unit.

A construction block unit 2 of the construction block kit 1 has a first side wall 3. The first side wall 3 has an outer side 4, an inner side 5, a proximal edge 6; a tongue 7 extending from the inner side 5, a bottom edge 8, a distal edge 9 and a top edge 18. In one embodiment, the tongue 7 is positioned midway between the bottom edge 8 and the top edge 18 and faces inward. In another embodiment, the tongue 7 is positioned near the proximal edge 6. In one embodiment, the proximal end of the tongue is rounded. The advantage of this will become evident, infra.

The construction block unit has a second side wall 10, which similarly has its own outer side 11, an inner side 12, a proximal edge 13, a tongue 14 extending from the inner side 12, a bottom edge 15, a distal edge 16, and a top edge 19. As in all cases, the tongue 10 is positioned between the bottom edge 15 and the top edge 19.

There is also a distal wall, 20. The distal wall 20 contains an outer side 21, an inner side 22, a top edge 23, a bottom edge 24, a first side edge 25; and a second side edge 26. A double receiving clip 27 extends along part of the height of the inner side of the distal wall 20 which captures and releasably retains the tongue of the first side wall and the tongue of the second side wall of a second construction block unit when the second the construction block is rotated ninety degrees to releasably mate with the first construction block.

Specifically, in one embodiment, the double receiving clip 27 has an upper clip 28 and a lower clip 29. In one embodiment, the upper side clip 28 and the lower side clip 29 are bounded or formed by a first clip wall 30 and a second clip wall 31. In another embodiment, the distal edges 32, 33 of the first clip wall 30 and the second clip wall 31 are attached or integral with the inner side of the distal wall 20.

A cross wall or cross section 34 integrally positioned between the first clip wall 30 and the second clip wall 31 is positioned at the proximal end of the first clip wall 30 and the second clip wall 31.

In one embodiment, the cross wall 34 does not extend along the full height of the first clip wall 30 or the second clip wall 31 but instead the top and bottom ends 35, 36 of the cross wall 34 terminates before reaching the ends of the first and second clip walls 31, 32. In another embodiment, the ends or lips 35, 36 of the cross wall are inwardly but roundedly beveled. This allows the rounded tongue 7 to be easily pushed in when two block units are mated.

Figure 5:
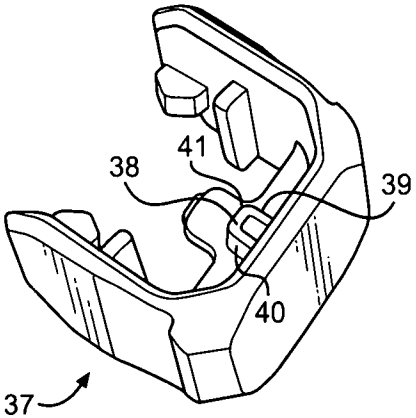
FIG. 5 is a rear perspective view of another embodiment of the block unit.

In yet another embodiment (shown in FIG. 5) of a singular unit 37, a cross wall 38 runs the height of the side walls 39 and 40. This particular cross wall 38 also does not have a beveled top 41 or bottom 42.

In yet another embodiment of the disclosure and as shown in most of the figures, there are a first connecting corner wall 43 and a second connecting corner wall 44. The first connecting corner wall 43 is positioned between the first side wall 3 and the distal wall 20, with the proximal edge 44 of the first connecting wall 43 integrally formed with or attached to the distal edge 9 distal end first side wall 3, and the distal edge 45 of the first connecting wall 43 integrally formed with or attached to the first side edge 25 of the distal wall 20. Of course, the first connecting corner wall also has a top edge 46 and a bottom edge 47.

Similarly, the second connecting corner wall 44 is positioned between the second side wall 10 and the distal wall 20, with the proximal edge 49 of the second connecting corner wall 48 integrally formed with or attached to the distal edge 16 of the second side wall 10 and the distal edge 50 of the second connecting corner wall 48 integrally formed with or attached to the second side edge 26 of the distal wall 20. As with all of the walls, in one embodiment, the edges are beveled.

In another embodiment of the connecting corner walls the corners created by the edges of the connecting corner walls are rounded.

In another embodiment, the construction block unit 51 does not have connecting corner walls. Instead, the side walls 3, 10 are connected directly to the ends of the distal wall 20.

It should be noted that in one embodiment, the first side wall, the second side wall, and the distal wall are identical in shape and size.

In another embodiment, the side wall, the second side wall, and the distal wall, along with the connecting walls are beveled along the edges.

Figure 7:
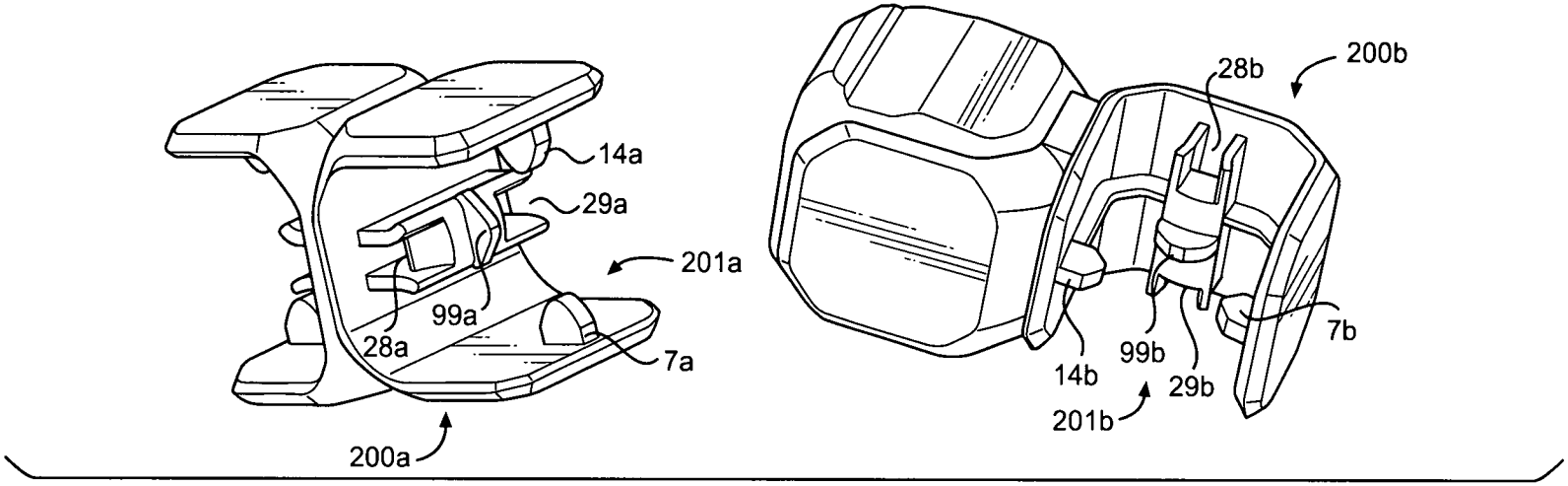
FIG. 7 is a perspective view showing the open end of two construction block units prior to assembly.

Referring to FIG. 7, two construction block units are reversibly linked together by first arranging the open faces 201*a*, 201*b* of the two units 200*a*, 200*b* perpendicularly. (For the purpose of simplicity, when discussing the assembly of the two separate construction block units, parts will be labeled "a" and "b"). As both of the open faces 201*a*, 201*b* of the construction block units 200*a*, 200*b* are pushed together in their perpendicular arrangement, tongues 7*a* and 14*a* are respectively pushed into and reversibly secured into clips 28*b* and 29*b*. As this is happening, clips 7*b* and 14*b* are respectively pushed into and reversibly secured into clips 29*a* and 29*a*. Hence, there are two identical reversible locking systems securing the construction block units 200*a* 200*b* at the same time. In one embodiment, within the construction block units there can be tongues 99*a*, 99*b* extending from between clips 28*a* and 29*a*, and clips 28*b* and 29*b* These tongues 99*a*, 99*b* can help prevent the two construction block units from being pushed against each other too far.

In most of the pieces of the construction block kit 1, the pieces are combination pieces. In other words, in addition to the construction block unit 2 itself, there are a number of pieces where different construction block units 2 are combined in different ways.

Figure 8:
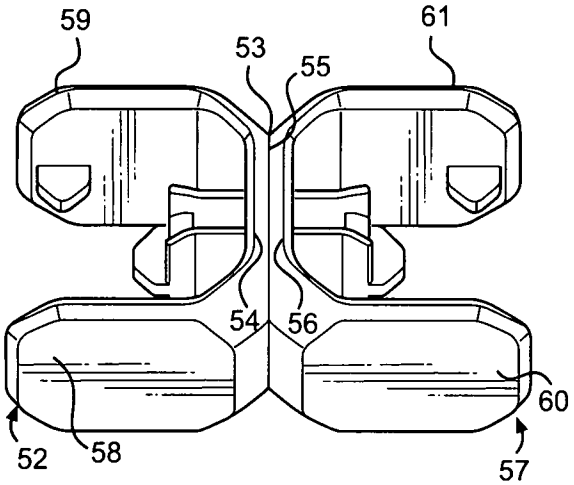
FIG. 8 is a perspective view of two construction block units molded or stuck together.

In one embodiment (FIG. 8), an outer side 53 of distal wall 54 of the first construction block unit 52 is attached to the outer side 55 of the distal wall 56 of the second construction block unit 57 wherein the side walls 58, 59, 60, 61 of the first said construction block unit 52 and said second construction block unit 57 are in alignment.

Figure 9:
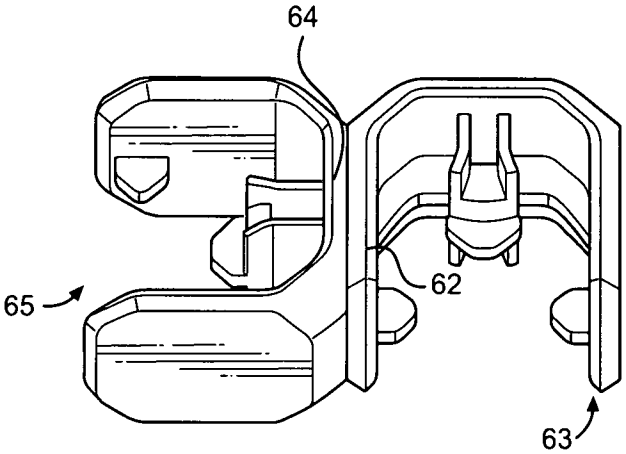
FIG. 9 is a perspective view of another embodiment of two construction block units molded or stuck together.

In another embodiment, a first sidewall 62 of the first construction block unit 63 is affixed to distal wall 64 of the second construction block unit 65 (FIG. 9).

It should be noted at this point that there are many ways that two sides of two or more blocks can be connected. They can be molded together, hot fused together, glued together, or put together by any other means known in the art.

There are many other combinations of pieces.

Figure 10:
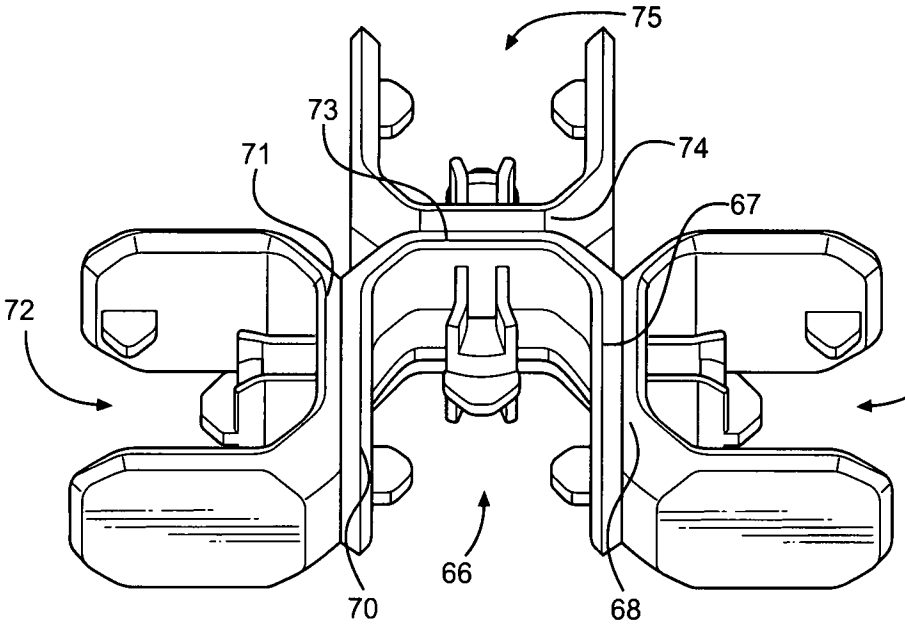
FIG. 10 is a perspective overhead view of four construction block units molded or stuck together.

Referring to FIG. 10, the first sidewall 62 of the first construction block unit 66 is integral with the distal wall 68 of the second construction block unit 69. The second sidewall 70 of the first construction block unit 66 is integral with the distal wall 71 of a third construction block unit 72.

In yet another embodiment, the distal wall 73 of the first the construction block unit 66 is integral with the distal wall 74 of the construction block unit 75.

Figure 12:
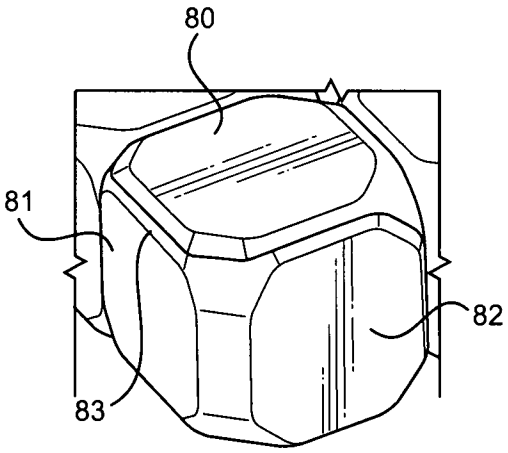
FIG. 12 is a perspective view of the underside of the spacer cube block unit.
Figure 11:
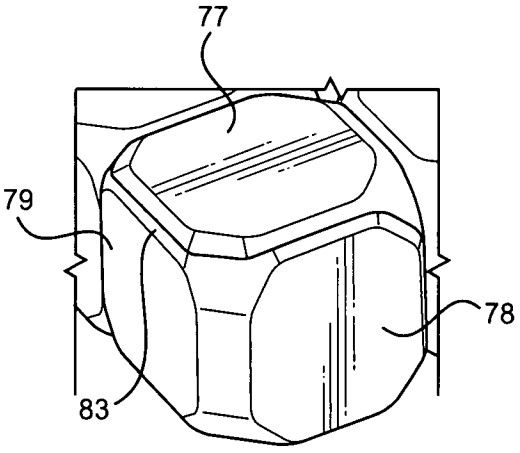
FIG. 11 is a perspective view of a spacer cube block unit.

In yet another embodiment, shown in FIGS. 11 and 12, there is a spacer cube 76. The spacer cube 76, as with any cube, has six sides 77, 78, 79, 80, 81, 82. Being a cube, each of the sides 77, 78, 79, 80, 81, 82 are equal to each other. It should be noted that any of the sides of the cube 76 are virtually identical to any of the sides of the other construction block unit. In this embodiment, the cube is beveled 83 on all sides. For the sake of simplicity, only one identifying number is used for the bevels, as beveled sides are shared.

Figure 13:
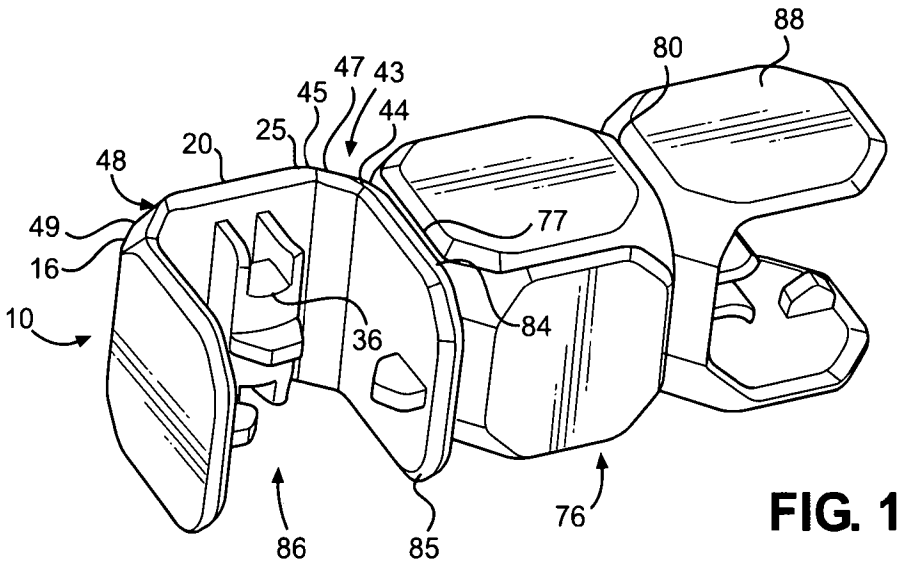
FIG. 13 is a perspective view of a spacer cube block unit having construction block units opposite each other.

This spacer cube 76 is used to increase the number of connections of the construction block unit kit 2. In the embodiment of FIG. 13, the first outside wall 84 of the first wall 85 of the first construction block unit 86 in FIG. 11 is connected to a first side wall 77 of spacer cube 76. Side 80 of spacer cube 76 attached to the distal wall 87 of the second construction block unit 88.

Figure 14:
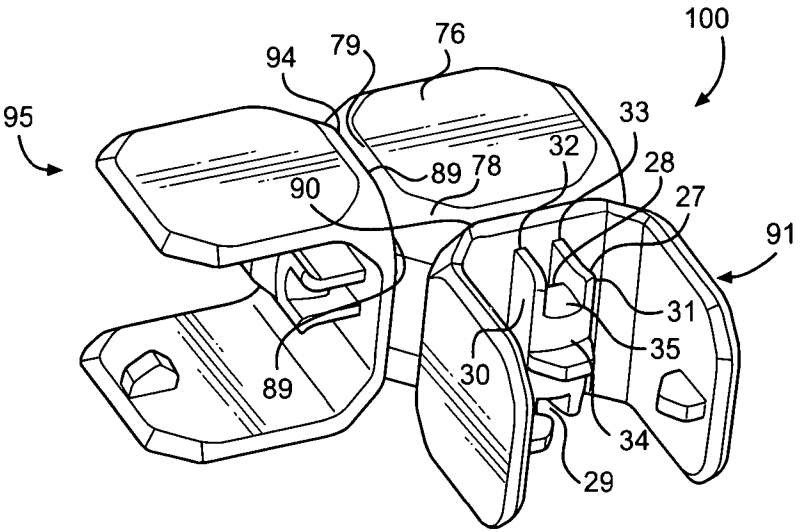
FIG. 14 is a perspective view of a spacer cube block unit having construction block units positioned on perpendicular sides of the spacer cube block unit.

In another embodiment, shown in FIG. 14, side 79 of spacer cube 76 is connected to the outer side 89 of distal wall 94 of first construction block unit 95. Next to side 79, in the ortho position, side 78 of the spacer cube 76 is connected to the a distal wall 90 of the second construction block unit 100.

Figure 15:
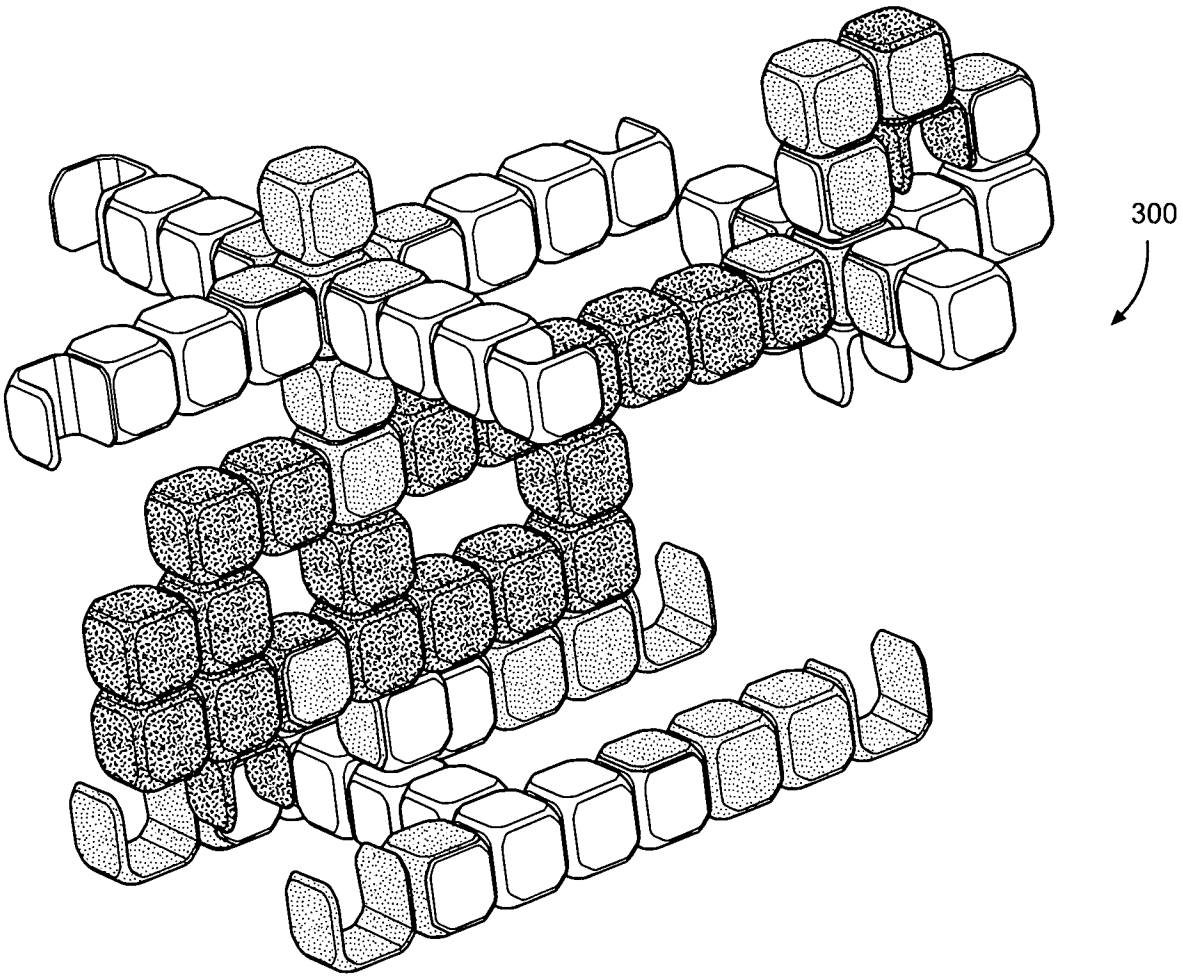
FIG. 15 is a perspective view of a toy helicopter made out of construction block units.
Figure 16:
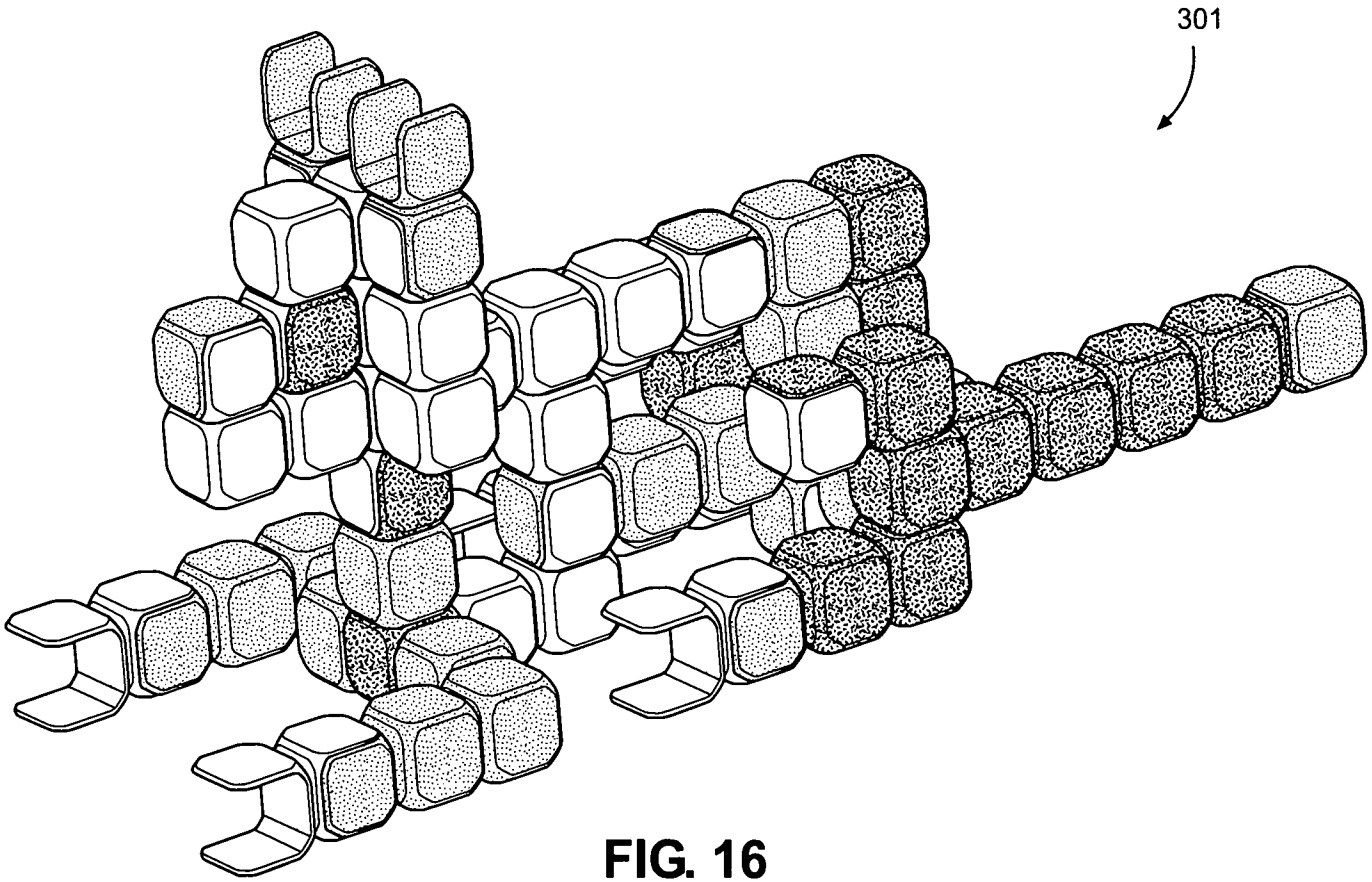
FIG. 16 is a toy dog made out of construction block units.
Figure 17:
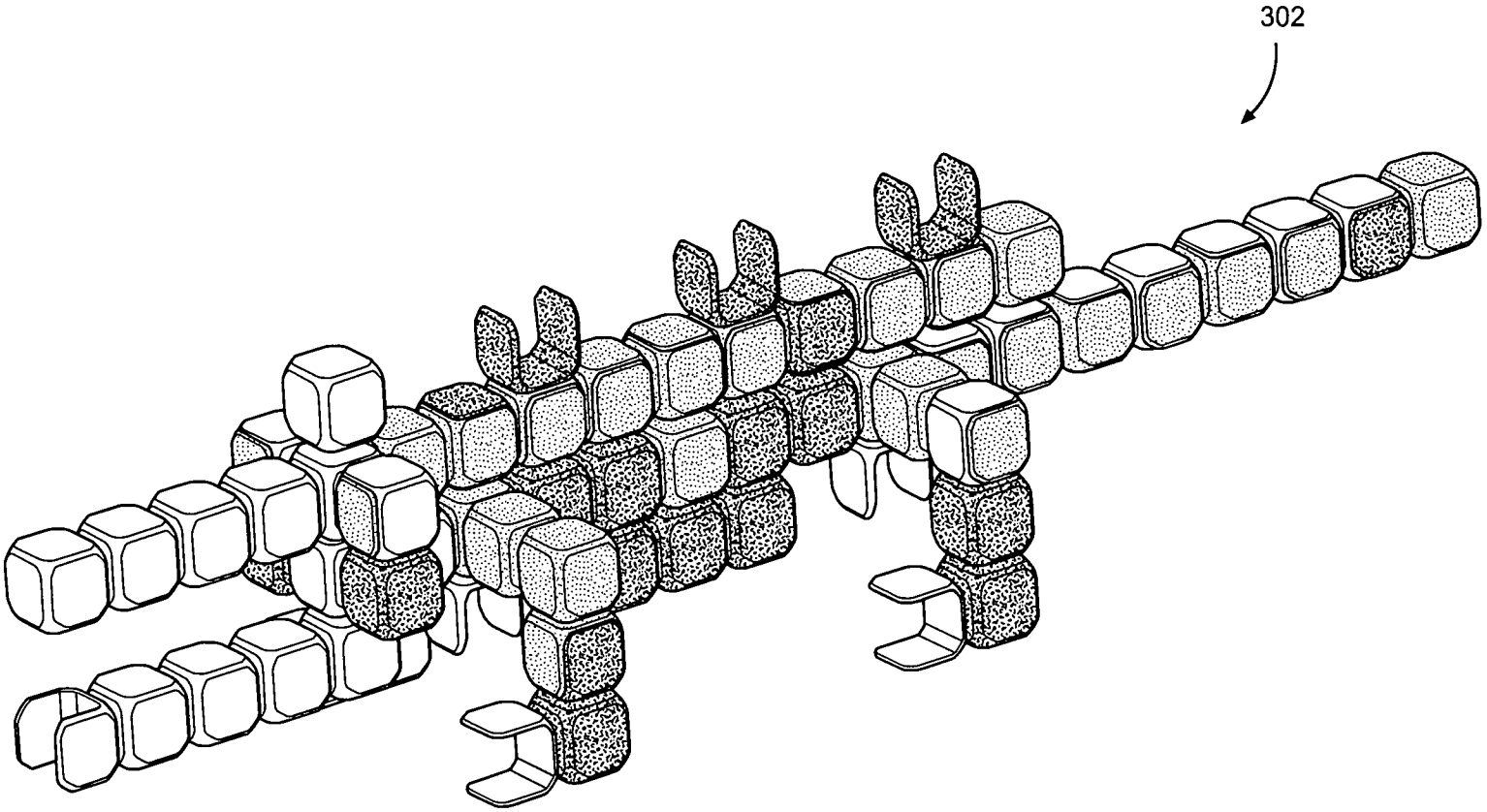
FIG. 17 is a toy animal made of construction block units.
Figure 19:
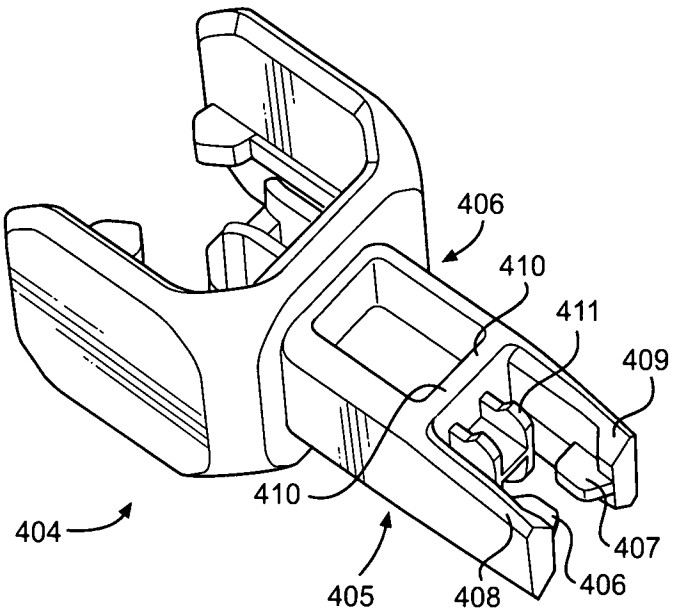
FIG. 19 is an overhead view of the axle block unit.

The blocks in any combination may be of any color and the only true limitations are those of a child's imagination. For instance, as shown in FIG. 15 is a helicopter 301 made out of the linked blocks. FIG. 16 shows a "dog" 301 made out of linked blocks, and FIG. 17 shows an "alligator 302."

Figure 18:
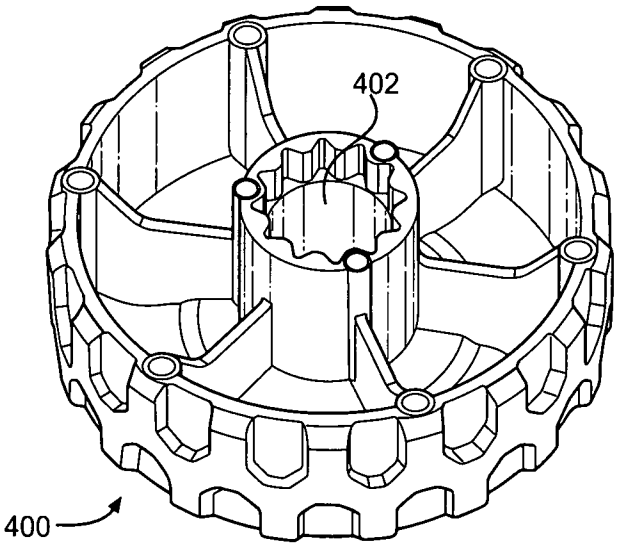
FIG. 18 is an overhead view of a wheel that is able to be used with the construction block units.
Figure 21:
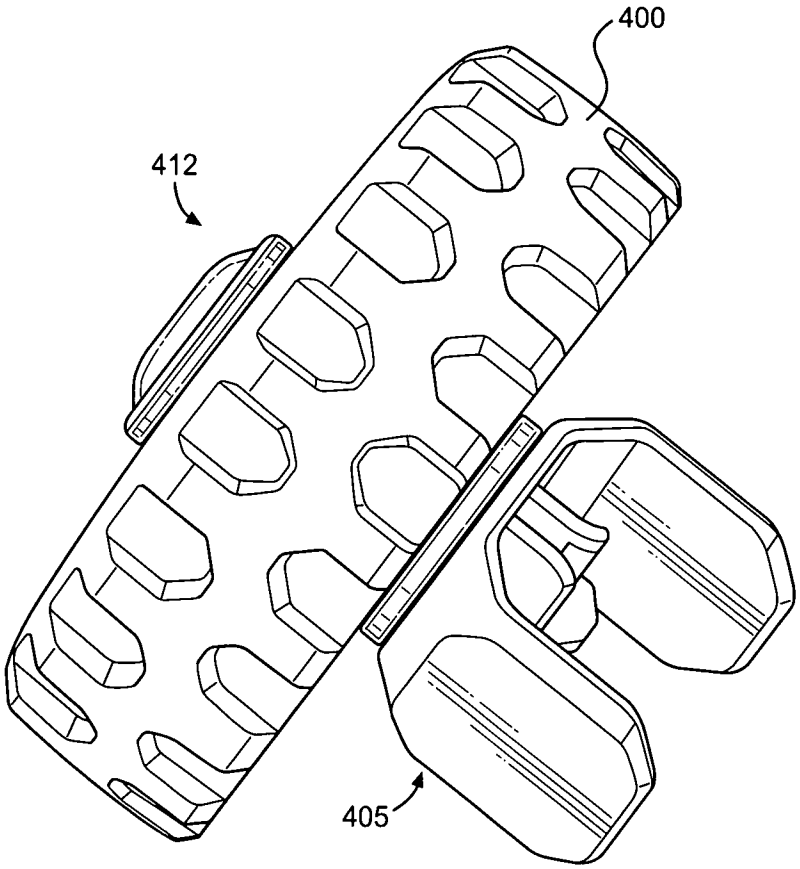
FIG. 21 is a perspective view of the complete wheel assembly.
Figure 20:
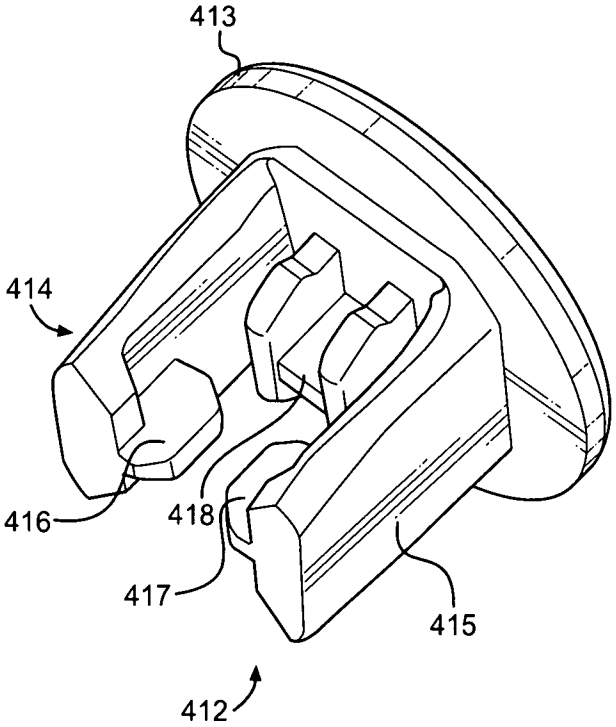
FIG. 20 is a perspective view of a snap cap which fits onto the axle block unit.

In another embodiment, a wheel can be attached to whatever is being constructed. FIG. 18 shows the wheel 400. The center 401 is hollow and, in one embodiment, with a ridged circumference 402. An axle block unit 403 has a construction block unit 404 and an axle assembly 405 extending from the distal wall 406. At the proximal end of the axle assembly 405, are two tongues 406, 407, facing inwardly from two walls 408, 409. A double receiving clip 411 is positioned/integral with a distal wall 410. The axle assembly 405 fits within the center 401 of wheel 400.

A snap cap 412 fits over the wheel, the diameter of the cap 413 of which exceeds the width of the center 401 of the wheel such that the cap 413 holds the wheel in place. The distal end of the snap cap 412 comprises two walls 414, 415 each of which has a tongue 416, 417 extending inward. Positioned at the proximal end between the two walls 415, 416 is a double receiving clip 418.

The axle assembly 405 is fitted through the center 401 of the wheel 400. The snap cap 412 is then snapped on to the proximal end of the axle assembly, and the wheel 400 is held on the axle assembly 405.

In another embodiment, a rotary block unit 420 is used to rotate linear or other structures about a center point. The rotary block unit 420 contains a circular hollow ring 421 fitted to a construction block unit 422. In one embodiment, the circular hollow ring 421 is integral with the construction block unit 422.

Figure 23:
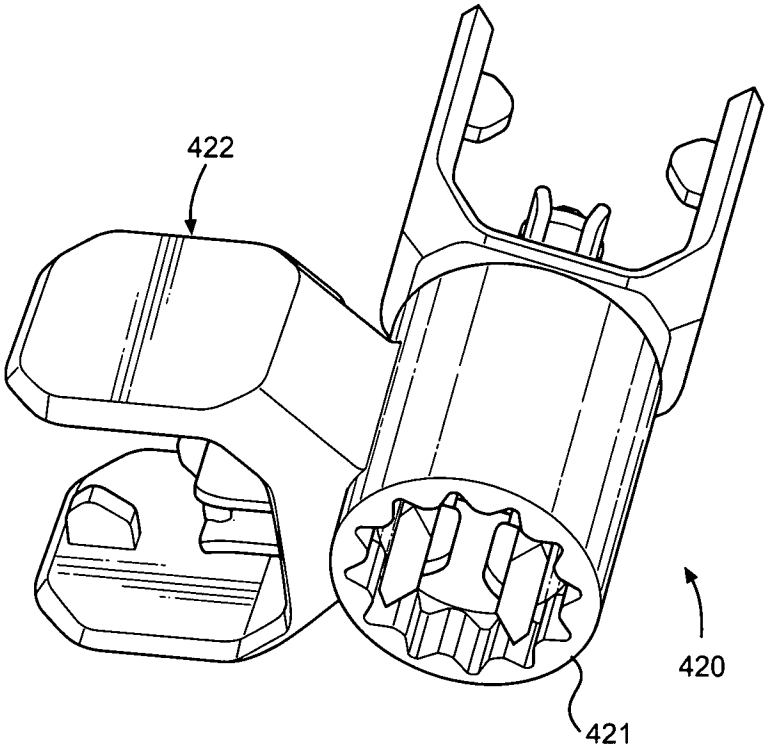
FIG. 23 is a perspective view of the axle assembly positioned through the opening of the rotary block unit.
Figure 22:
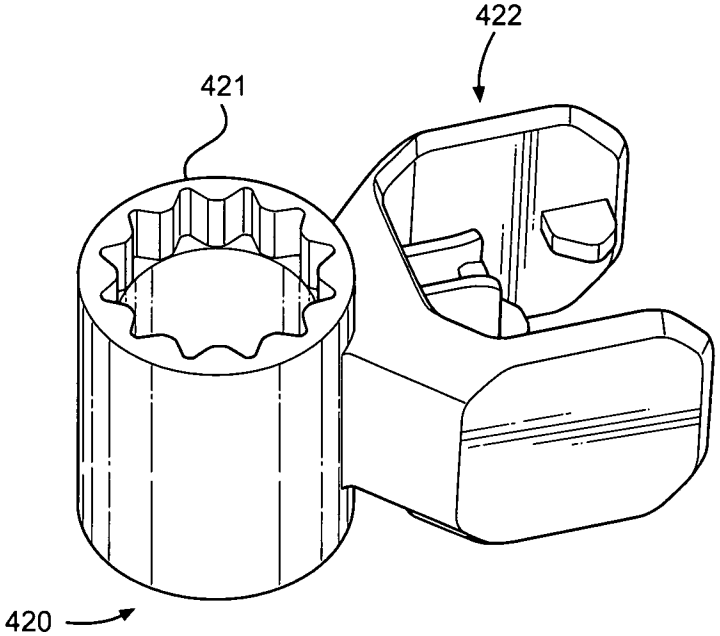
FIG. 22 is an overhead perspective view of a rotator block unit.

In one proposed usage the axle assembly 405 of the axle block unit 403 the hollow ring 421 (See FIG. 23). The snap cap fits on top attaching to the axle assembly 405.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents.

What I claim is:

1. A construction block kit, comprising a first block unit piece, said first block unit piece comprising a single block unit, said single block unit comprising:

a) a first side wall, said first side wall comprising:

1) an outer side;

2) a flat inner side;

3) a proximal edge;

4) a tongue extending from said inner side;

5) a top edge;

6) a bottom edge; and 7) a distal edge;

b) a second side wall, said second side wall comprising;
1) an outer side;
2) a flat inner side;
3) a proximal edge
4) a tongue extending from said inner side, said tongue positioned at the same height as the tongue of said first side;
5) a top edge;
6) a bottom edge; and
7) a distal edge, said first side wall being parallel with said second side wall;

c) a distal wall, said distal wall comprising:
1) an outer side;
2) a flat inner side;
3) a top edge;
4) a bottom edge;
5) a first side edge;
6) a second side edge; and
7) a double receiving clip extending from the inner side of said distal wall, d) A first connecting corner wall, said first connecting corner wall comprising:
1) a proximal edge;
2) a distal edge;
3) a top edge;
4) a bottom edge;

wherein said proximal edge of said first connecting corner wall is in communication with said distal edge of said first side wall, and said distal edge of said first connecting corner wall is in communication with said first side edge of said distal wall; and e) a second connecting corner wall, said second connecting corner wall comprising:
1) a proximal edge;
2) a distal edge;
3) a top edge;
4) a bottom edge;

wherein said proximal edge of said second connecting corner wall is in communication with said distal edge of said second side wall, and said distal edge of said of said second connecting corner wall is in communication with said second side edge of said distal wall;

and wherein said double receiving clip has the ability to capture and retain the tongue of said first side wall and the tongue of said second side wall of said construction block unit when said construction block unit is rotated ninety degrees in relation to another said construction block unit.

2. The construction block kit of claim 1, wherein:

a) said first connecting corner wall is positioned angularly between the distal edge of said first side wall, and said first side edge of said distal wall; and b) said second connecting corner wall is positioned angularly between the distal end of said second side wall and the second side edge of said distal wall.

3. The construction block kit of claim 1, wherein:

a) said first connecting corner wall is rounded; and b) said second connecting corner is rounded.

4. The construction block kit of claim 1, further comprising a second block unit piece comprising a first said construction block unit and a second said construction block unit, said outside wall of said distal wall of said first said construction block unit being attached to and in alignment with said outside wall of said distal wall of said second said construction block.

5. The construction block kit of claim 1, wherein each said first side wall, each said second side wall and each said distal wall of each said construction block unit are identical in shape and size.

6. The construction block kit of claim 1, wherein each edge of each of the first side wall, said second side wall, and said distal wall are beveled.

7. The construction block kit of claim 1, further comprising a second block unit piece comprising a first said construction block unit and a second said construction block unit, said first sidewall of said first said construction block unit is affixed to said distal wall of said second said construction block unit.

8. The construction block kit of claim 7, wherein said first sidewall of said first said construction block unit is integral with said distal wall of said second said construction block unit.

9. The construction block kit of claim 7, further comprising a third block unit piece, wherein a distal wall of a third said construction block unit is connected to said second side wall of said first said construction block unit.

10. The construction block kit of claim 9, further comprising a fourth block unit piece, wherein a distal wall of a fourth said construction block unit is attached to said distal wall of said first said construction block unit.

11. The construction block kit of claim 1, further comprising a spacer cube block unit, said spacer cube block unit comprising six block side walls, each said block side wall having same outer dimensions as any said side wall of said construction block unit.

12. The construction block kit of claim 11, wherein said first side wall of said construction block unit is attached to a first block side wall of said spacer cube block unit.

13. The construction block kit of claim 11, wherein said distal wall of said construction block unit is attached to a first block side wall of said spacer cube block unit.

14. The construction block kit of claim 11, wherein said first side wall or said distal wall of a first said construction block unit is attached to a second block side wall of said spacer cube block unit.

15. The construction block kit of claim 14 comprising a third block unit piece, wherein a first side wall or a distal wall of a third said construction block unit is connected to another said block side wall of said spacer cube block unit.

16. The construction block kit of claim 15 further comprising a fourth block unit piece wherein a first side wall or a distal wall of a fourth said construction block is connected to another said block side wall of said spacer cube block unit.

17. The construction block kit of claim 16 further comprising a fifth block unit piece, wherein a first side wall or a distal wall of a fifth said construction block unit is connected to another said block side wall of said spacer cube block unit.

18. The construction block kit unit of claim 17 further comprising a sixth said construction block unit, wherein a first side wall or a distal wall of a sixth said construction block is connected to another said block side wall of said spacer cube block unit.

19. The construction block kit of claim 11, comprising a plurality of said spacer cube block units, wherein said block side wall of one said spacer cube block is connected to said block side wall of another said spacer cube block unit.

20. A construction block kit comprising a first block unit piece, said first block unit piece comprising a single block unit, said single block unit comprising:

a) a first side wall, said first side wall comprising:
1) an outer side;
2) a flat inner side;
3) a proximal edge;
4) a tongue extending from said inner side;
5) a top edge;
6) a bottom edge; and
7) a distal edge;

b) a second side wall, said second side wall comprising;
1) an outer side;
2) a flat inner side;
3) a proximal edge
4) a tongue extending from said inner side, said tongue positioned at the same height as the tong of said first side;
5) a top edge;
6) a bottom edge; and
7) a distal edge, said first side wall being parallel with said second side wall;

c) a distal wall, said distal wall comprising:
1) an outer side;
2) a flat inner side;
3) a top edge;
4) a bottom edge;
5) a first side edge;
6) a second side edge; and
7) a double receiving clip extending from the inner side of said distal wall, said double receiving clip has the ability to capture and retain the tongue of said first side wall and the tongue of said second side wall of said construction block unit when said construction block unit is rotated ninety degrees in relation to another said construction block unit, wherein said distal edge of said first side wall is attached to said first side edge of said distal wall, and said distal edge of said second side wall is attached to said second side edge of said distal wall.

* * * * *